US006937181B2

(12) United States Patent
Mathiasson

(10) Patent No.: US 6,937,181 B2
(45) Date of Patent: Aug. 30, 2005

(54) DEVICE FOR REDUCING THE SIGNATURE OF HOT EXHAUSTING GASES

(75) Inventor: Urban Mathiasson, Dalarö (SE)

(73) Assignee: Forsvarets Materielverk, Stockholm (SE)

( * ) Notice: Subject to any disclaimer, the term of this patent is extended or adjusted under 35 U.S.C. 154(b) by 0 days.

(21) Appl. No.: 10/481,584

(22) PCT Filed: Jun. 21, 2001

(86) PCT No.: PCT/SE01/01436

§ 371 (c)(1),
(2), (4) Date: Apr. 22, 2004

(87) PCT Pub. No.: WO03/004296

PCT Pub. Date: Jan. 16, 2003

(65) Prior Publication Data

US 2004/0169599 A1 Sep. 2, 2004

(30) Foreign Application Priority Data

Dec. 23, 1999 (SE) ..... 9904776

(51) Int. Cl.[7] ..... H04K 3/00

(52) U.S. Cl. ..... 342/14; 342/13; 239/127.1; 60/320

(58) Field of Search ..... 342/1, 2, 3, 13, 342/14; 239/127.1, 127.3, 265.17, 265.19, 265.23; 60/39.5, 39.511, 39.512, 39.52, 317–321

(56) References Cited

U.S. PATENT DOCUMENTS 5,786,785 A 7/1998 Gindrup et al.
5,992,140 A * 11/1999 Hammond et al. ..... 60/39.5
6,122,907 A * 9/2000 Frawley ..... 239/265.17
6,134,879 A * 10/2000 Frawley et al. ..... 60/39.5
6,385,968 B1 * 5/2002 Gustafsson et al. ..... 60/320
6,662,546 B1 * 12/2003 Giffin, III ..... 60/39.5
6,662,892 B2 * 12/2003 Falk et al. ..... 60/320

FOREIGN PATENT DOCUMENTS

| | | |
|---|---|---|
| EP | 0 945 601 | 9/1999 |
| GB | 2 237 862 A | 5/1991 |
| SE | 9904776 | 6/2001 |
| WO | 03/004296 | 1/2003 |

* cited by examiner

*Primary Examiner*—Bernarr E. Gregory
(74) *Attorney, Agent, or Firm*—Jacobson Holman PLLC

(57) ABSTRACT

The invention relates to a device for exhausting hot gases with a reduced signature, for instance exhaust gases from an exhaust (7, 8) of a tank. The device is of the type comprising a means for mixing (9, 33) of the hot gases with fresh air from the exterior of the tank. To prevent the exhaust from, for instance, reflecting radar radiation and emit IR radiation, the device is provided with a protecting means (10, 34) which is positioned outside at least parts of said means. The device may comprise a space (12, 32) which accommodates preferably the entire means for mixing. The space is defined on the one hand by a shell (11, 31) towards the other spaces of the tank and, on the other hand, by the protecting means towards the exterior. The protecting means has openings (23, 25) for passing preferably a gas mixture from the means to the exterior and fresh air from the exterior to said means. The device can be mounted in the tank (1, 2) with a suitably plane outer surface of the protecting means flush with the plane outside of the tank.

15 Claims, 2 Drawing Sheets

DEVICE FOR REDUCING THE SIGNATURE OF HOT EXHAUSTING GASES

This is a nationalization of PCT/SE01/01436 filed Jun. 21, 2001 and published in English.

FIELD OF THE INVENTION

The present invention relates to a device for reducing the signature of units as regards different kinds of emitted and reflected energies. These units may be military service units or means of transport, such as stationary electric power plants and respectively military vessels and vehicles. The device, which includes a mixing element for mixing the hot gases with fresh air from the exterior of the unit, aims at, for instance, reducing the IR radiation from emission of hot gases, such as exhaust gases from engines, ventilation air or cooling air from different kinds of units, and mastering the surveillance radiation, for instance radar radiation, which is reflected by the exhaust device.

BACKGROUND ART

The aim is to reduce the signature of e.g. military vehicles using stealth technique. This is achieved, inter alia, by the vehicles being as far as possible prevented from emitting compromising emanations from, for instance, hot surfaces or emitted hot gases and from reflecting energy, for instance, from an enemy's reconnaissance equipment. The surveillance radiation may be microwave radiation, such as radar or laser radiation.

The heat radiation, which can be detected by IR sensors, can be reduced by the hot gases being cooled before being emitted. As a result, also the temperature of the surfaces associated with the exhaust is usually reduced. This is carried out according to prior-art technique, for instance, by fresh air from the exterior being added to the exhaust gases before being emitted. The effect of the exhaust on the heat signature of the vehicle highly depends on the difference between the heat radiation from the exhaust, i.e. from the surfaces of the exhaust as well as the emitted hot gases, and the parts of the vehicle which surround the exhaust. Attempts are made to reduce this difference to such an extent that the exhaust cannot be localised on a sensor image of the vessel and preferably to such an extent that the exhaust does not add to the signature of the vessel.

The reflection of radar energy can be reduced significantly according to the above-mentioned stealth technique, usually by the vehicle absorbing the received radiation or letting as much as possible thereof be reflected in a predetermined direction which is different from the direction to the sender. The absorption can be provided by special absorbing materials on the surfaces of the vehicle. The reflection can be controlled by the vessel being made with plane surfaces which are electrically conductive and by not having cavities with inner corners that cause scattered reflection of the received radiation. Without this signature adaptation, the radiation is reflected in an uncontrolled manner in a large polar angular range and will, depending on the character of the vehicle, be reflected to a varying degree to the location of transmission. A particularly great amount is reflected if the vehicle happens to comprise areas formed as corner reflectors.

In the known exhausts, the reflecting radar energy is usually not taken into consideration. In most cases, they have naked cavity-forming outlets even if they are signature adapted to IR radiation. A common known embodiment is an exhaust pipe which is surrounded by a pipe to which fresh air is supplied. The supply of this air can be driven by means of an electric fan or by the exhaust gases acting as a drive gas in an outlet part formed as an ejector.

The drawbacks of the known solutions to the problem are that

- they do not sufficiently consider the problems with the compromising emission of heat and/or the reflection of radar energy
- they often utilise complicated equipment, such as electric fans, which makes the devices complicated and expensive to manufacture and maintain as well as vulnerable in a fighting environment.

DESCRIPTION OF THE INVENTION

Technical Problem

The object of the invention is to provide a device as mentioned by way of introduction for reducing the signature of hot gases exhausted from, for instance, vehicles and vessels. By means of the device, their radiation and/or reflection of, for instance, IR heat and radar radiation from devices for such exhausts should be reduced to an acceptable level.

The Solution

This object is achieved by the device in accordance with the present invention.

According to the invention, an exhaust device is suggested, which comprises a mixing means and a protecting means. In the mixing means, the hot gases are mixed with a second gas which is cooler than the hot gases, in order to cool them. This second gas can be a gas which has already been used in the unit, for instance the vessel, but is preferably air from the atmosphere surrounding the vessel. The device is adapted then to pass the mixed gas flow to this atmosphere.

The protecting means is relative to the vessel arranged outside the mixing means or at least parts thereof, for instance an outlet, in order to master the surveillance radiation so that these parts do not reflect the radiation more than to an acceptable extent.

Moreover, it is suggested that the protecting means be adapted to pass the entire mixed gas flow, or parts thereof, to the atmosphere. To this end the protecting means is provided with ducts for conducting gases. These gases can be mixed gases only. In the preferred embodiment, such ducts are, however, also used to supply the second gas, the fresh air from the exterior, to the mixing means. When changing the direction of the gas flows, the same ducts may be used. The parts of the protecting means which are heated by mixed gases can, by thermal conduction, be cooled by the parts through which cool fresh air flows. As a result, the mixed gases are cooled, even before they are emitted to the exterior.

The mixing means may be a motor-driven fan, but preferably, if the hot gases have a pressure above atmospheric, an ejector which is driven by these. The ejector is simple and manages without motor or other movable parts. Moreover, the gases are mixed well in the outlet nozzle of the ejector, which reduces differences in temperature of the mixed gas and, thus, its maximum temperature. Except the use of a conventional ejector, the use of an ejector is suggested, which is adapted to the purpose and that is formed of, inter alia, a number of guide vanes.

In a further development, the exhaust device is suggested to comprise also a space to which the outlet of the mixing means could be connected. But, according to the preferred embodiment, the space accommodates essentially the entire mixing means. The space could be arranged outside the vessel, but is preferably located inside an opening, for instance in the side of the vessel, and is limited outwards by the protecting means covering this opening. The space is limited inwards in a gas-tight manner by a cup-shaped shell, which along its periphery is fixed to the side of the vessel. A pipe arranged through a hole in the shell is used to conduct the hot gas to the mixing means.

The protecting means could master the received surveillance radiation by absorbing it. The protecting means could then be covered with a porous absorbing material which allows, for instance, mixed gases to be screened through. But, as in the preferred embodiment, it is suggested that this should take place on the one hand by the radiation being prevented from penetrating into the space to be reflected there by parts of the mixing means and, on the other hand, by being reflecting in a controlled manner by the outer surface of the protecting means in a harmless direction in the same way as for the parts of the vehicle which surround the exhaust. This is achieved if the openings of said ducts at the outer surface of the protecting means have a circumference the size of which is smaller than the wavelength of the surveillance radiation, and if the outer surface of the protecting means is plane and flush with the vessel wall, and has certain material properties. For good efficiency, the protecting means should contain an electrically conductive material and preferably be in galvanic or conductive contact with the body of the vehicle.

If the protecting means is besides arranged with a good fit in the vessel wall, no reflecting cavities are obtained in the joints between the protecting means and the rest of the vessel. If it is not possible to avoid gaps, these should be filled with a radiation-absorbing agent. The device will then be regarded as part of the plane section of the vessel wall and adds nothing, or very little, to, for instance, the radar signature of the vessel. The outer surface does not have to be quite plane. It could have the shape of a pyramid or ridge, for instance if the surrounding vehicle wall is not plane.

In order not to increase the IR signature of the vessel, the exhaust device is arranged with screening elements to prevent heat, especially IR radiation, from radiating directly to the exterior from the hot gases and parts of the device which are heated by these gases. The screening elements can be positioned in the protecting means, for instance, in the form of a grating or as parts of the mixing means, such as the above-mentioned guide vanes of an ejector.

Advantages

According to the invention, a simple device is obtained for emitting hot gases from a vessel without significantly increasing g the signature of the vehicles. It may here be mentioned that the exhaust is usable also on boats in which previously the exhaust gases were emitted below the water surface for reduced IR signature. With improved sonar systems, however, this is no longer possible.

DESCRIPTION OF THE DRAWINGS

A preferred embodiment will now be described in more detail with reference to the accompanying drawings, in which the reference numerals designate equivalent parts in the Figures.

PREFERRED EMBODIMENT

The embodiment will be described by means of two alternatives of an exhaust for exhaust gases of a tank. What particularly distinguishes the alternatives from each other is on the one hand the composition of the mixing means and, on the other hand, the location of these means in relation to the armour plating of the tank. The invention is not limited to the combinations of mixing means and locations described below.

Figure 1A:
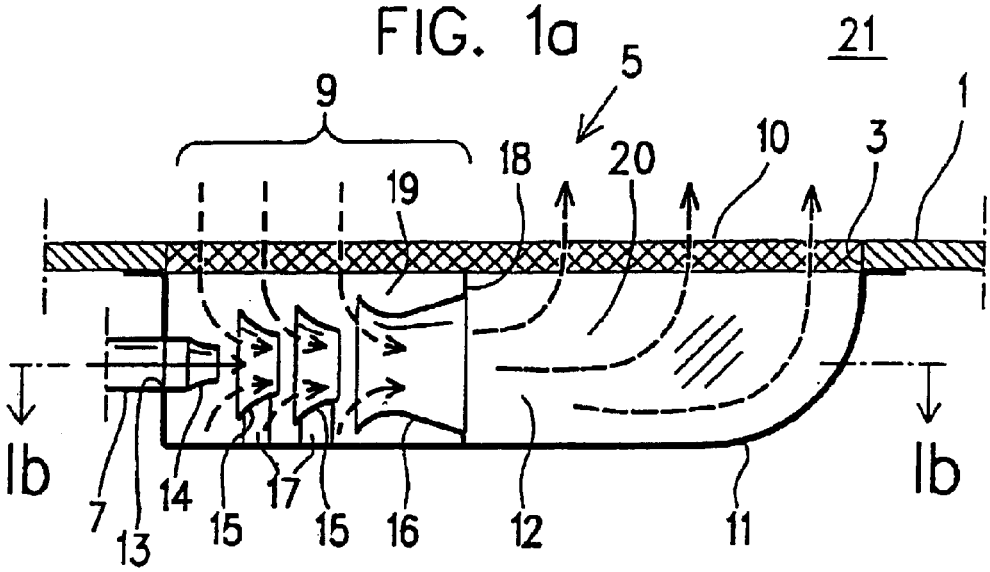
FIG. 1*a* is a horizontal longitudinal section of a first alternative of the device according to the invention for emitting exhaust gases from a tank.
Figure 1B:
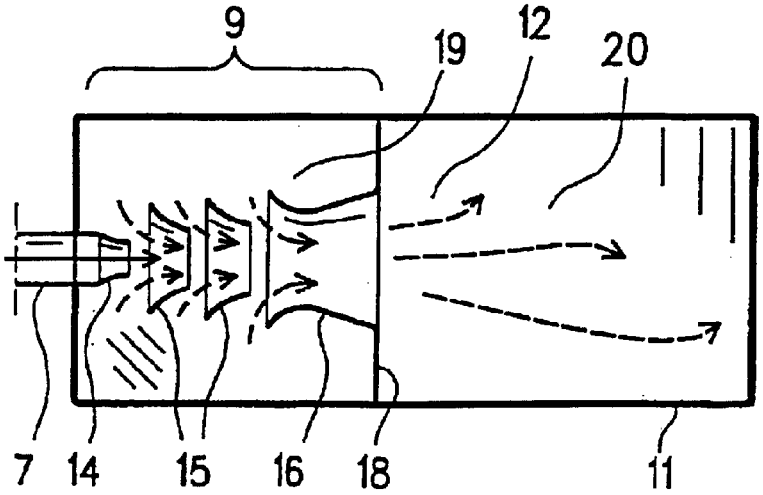
FIG. 1*b* shows the device in FIG. 1*a* in a vertical longitudinal section 1*b*—1*b*, rotated through 90°.

FIGS. 1*a* and 1*b* show an exhaust the mixing means of which is a conventionally designed ejector. The ejector is accommodated in a space which is arranged inside the armour plating. The exhaust shown in FIG. 3 has, however, an ejector which is specifically designed for the purpose and is accommodated in a space which essentially is located outside the armour plating.

Figure 3:
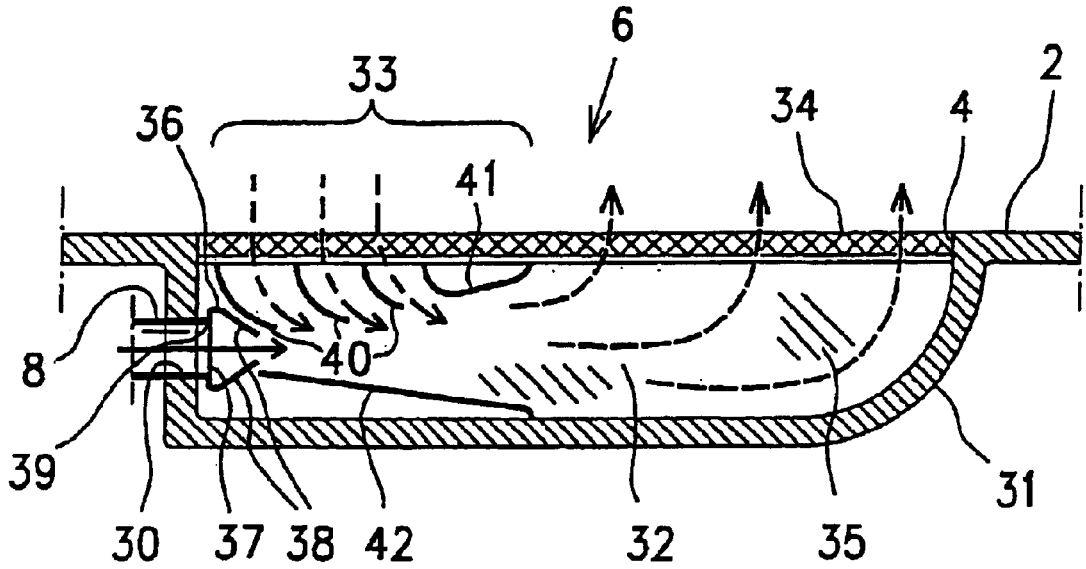
FIG. 3 is a longitudinal section of a second alternative of the device.

In FIGS. 1*a* and 3, the designations 1 and 2 are side walls of armour plating of the tank. Said exhausts 5, 6 are flush mounted in openings 3, 4 in these walls. Exhaust pipes 7, 8 are arranged from the engine of the tank to its exhaust.

The exhaust 5 in FIGS. 1*a* and 1*b* has as its main components an ejector 9, a protecting means 10 and a limiting shell 11. This shell is formed as a parallelepipedal trough and surrounds together with the protecting means 10 a space 12 in which the ejector is arranged. The shell is made of steel sheet and impervious to gases and attached in a gas-tight manner to the inside of the side wall of the tank at the opening edge by means of screws (not shown) and a sealing and heat-insulating flat gasket. As a result, the space is completely separated from the interior of the tank. The exhaust pipe of the tank extends to the space through a through hole 13 in one side wall of the shell. A heat-insulating and sealing gland (not shown) is arranged between the pipe and the shell round said hole.

The ejector 9 is a multistage ejector and comprises a number of parts which are rotationally symmetrically mounted on a common longitudinal axis, one part being positioned at a distance from the other in the following order: a main nozzle 14, two intermediate nozzles 15 and an expansion nozzle 16. Each of the parts, as well as the distances between them, has been given such a design and size, by calculations and testings, that the ejector has obtained the desired qualities.

The main nozzle 14 is tubular and made of heat resistant pressed steel sheet and attached by means of threads to the end of the exhaust pipe which extends a distance into the space. It has a diameter decreasing towards its free end, whose final dimension is most important to the operation of the ejector. The two intermediate nozzles 15 are uniform, the latter intermediate nozzle being slightly greater than the former. They are annularly made of pressed metal sheet with a decreasing diameter just like the main nozzle and are each attached to the bottom of the shell by means of a metal sheet double support 17.

The expansion nozzle 16, which is also made of pressed metal sheet, has an inlet part which resembles the intermediate nozzles. However, the expansion nozzle passes, after a retracted well rounded intermediate part, into an expansion tube at whose end the expansion nozzle is attached by welding to a partition wall of steel sheet 18 around a through hole in the wall. The partition wall, which is welded to the bottom and sides of the shell, divides the space into a mixing portion 19 and an outlet portion 20.

The protecting means 10 limits said space 12 towards the exterior 21 and acts as a lid which is fitted to the shell and also connects to the tank side. The design of the protecting means is most easily described by indicating the function of the exhaust. As exhaust gases flow out through the ejector nozzle, a negative pressure is generated in the ejector. Fresh air from the exterior is then supplied by suction to the mixing portion 19 of the space through ducts formed in the protecting means or, for instance, through a gap between the protecting means and the tank wall. The exhaust gases are then mixed with this fresh air to mixed gases which are passed to the outlet portion 20 of the space, whose pressure above atmospheric acts to pass these gases to the exterior through other ducts made in the protecting means or, for instance, through a gap outside the protecting means.

Moreover the protecting means is arranged so that radar radiation behaves in the same way on its outer surface as on the wall surfaces surrounding the protecting means and so that it does not let out any heat radiation from hot gases and parts located inside the protecting means.

Figure 2:
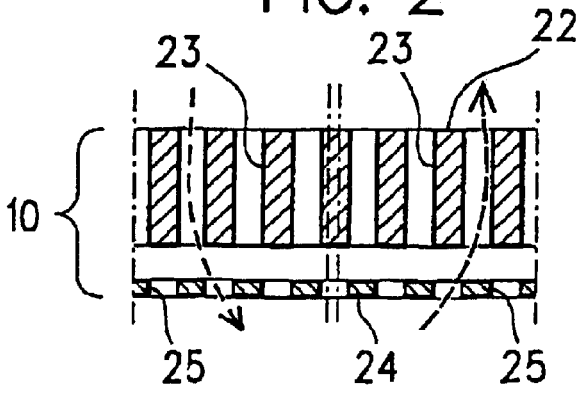
FIG. 2 is a longitudinal section of a protecting means from the device in FIGS. 1*a* and 1*b* in detail.

For said space to be located inside the armour plating of the tank, the protecting means comprises a plate 22, see FIG. 2, which, when completed, has the same protective value as the walls of the tank. The plate is conveniently made of armour plating, slightly thicker than the armour plating in the walls of the tank. The plate has through holes 23 to be passed by fresh air and mixed gases. The holes are made by laser and have a diameter in the outer surface which is adapted to the enemy's radar, as described in the introductory part. A number of holes having d=9 mm has been selected which is so great that an acceptable flow resistance of the gas flows is obtained.

The extent of the plate is fixed, inter alia, by the size of the holes and the distance between them. The plate should be electrically connected to the tank wall and be well fitted with its outer surface flush with the outer surface of the tank wall. The plate could be fastened by means of, for instance, screws but is in this alternative welded to the armour plating of the wall. The shell 11 located inside the plate is, of course, dimensioned according to the size of the plate and the ejector.

To prevent IR heat from radiating through the plate holes, the protecting means comprises a screen plate 24 with holes 25 of the same diameter and centre distance as in the plate, but offset by half a spacing both longitudinally and transversely. The screen plate is located inside the plate at a distance from the plate which slightly exceeds the diameter of the holes.

Alternative Embodiment

The alternative exhaust, which is shown in FIG. 3, will probably weaken the armour protection less since said space is located outside the armour plating. This exhaust is therefore suited for vehicles with a stronger armour plating than the exhaust described above. The vulnerable area in the armour plating is then limited to a hole 30 for the exhaust pipe instead of that part of the plate 22 which contains the holes 23.

Like the previously described exhaust, this alternative comprises a limiting shell 31 for a space 32, an ejector 33 arranged in the space and operating as a mixing means, and a protecting means 34. The trough-like shell is made of armour plating and has the same thickness as the tank wall 2. It has approximately the same parallelepipedal inner dimensions as the first described exhaust. The shell is, with a horizontal main direction, welded along its edge to the opening 4 of the side wall 2 and will thus constitute part of the armour plating. In addition to a bottom, it has two plane parallel shell sides, of which the inside 35 of the floor side is shown, and also two side walls. The opening of the entire space is sealed by the protecting means 34 which is attached along the periphery by means of screws to the armour plating so that its plane outer surface is flush with that of the tank side.

The ejector 33, which operates with essentially two-dimensionally directed gas flows, comprises a number of ejector parts 36, 40, 41 and 42 that will be described below. These are sections of steel sheet, i.e. of the same cross-section along their length, and extend parallel to the end walls of the shell between the inside 35 of the floor side and the inside of opposite roof side. The exhaust pipe 8, which in the centrally arranged hole 30 with a heat-insulating seal penetrates through one end wall of the shell trough, opens in a distribution box 36 which distributes the exhaust gases vertically.

The distribution box is symmetrically U shaped in cross-section and consists of an intermediate piece 37 and two side pieces 38. The intermediate piece is formed with a centrally arranged hole, into which the exhaust pipe 8 is inserted with an intermediate heat-insulating seal. The gap between the side pieces tapers towards the outlet opening, so that this opening will have an area, suitable by testing for its function as the nozzle of the ejector. The distribution box is at its ends fastened in a heat insulated manner to the inside of the bottom side and the roof side. The distribution box is arranged with its symmetry plane parallel to the outer surface of the protecting means 34.

Moreover the ejector parts comprise on the one hand, in that part of the space which is divided by the symmetry plane of the distribution box and facing the protecting means, a number of guide vanes 40 and a nozzle plate 41 and, on the other hand, in the other part of the space a guide plate 42 which extends from the opening of the distribution box the same distance as does the nozzle plate to the bottom of the shell.

The guide vanes, which operate as intermediate nozzles, are straight or preferably circular-arc-shaped in cross-section. In the latter case, they are arranged with one arc edge just inside the protecting means and approximately perpendicular to the protecting means. They have such a size that the distance between the other arc edge and said symmetry plane increases for each additional guide vane seen from the distribution box. After the last guide vane the nozzle plate 41 is arranged to create, together with the guide plate 42, a restriction and the expansion nozzle of the ejector.

Figure 4:
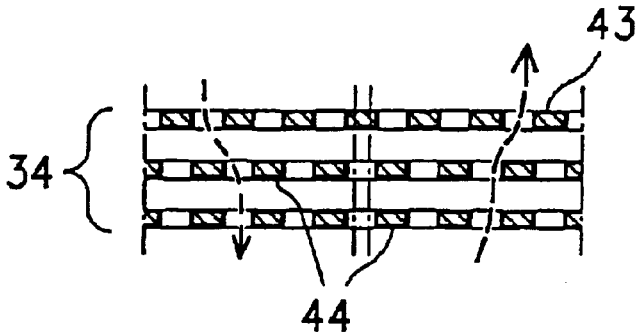
FIG. 4 is a longitudinal section of a protecting means from the device in FIG. 3 in detail.

In this alternative, the protecting means 34 need not have armouring properties. Nor does it have to be able to screen off IR radiation to the same extent since the guide vanes can take care of this, where the hottest parts of the space are positioned. The protecting means, see FIG. 4, comprises an outer plate 43 made of steel sheet with holes similar to those in the protecting means of the first embodiment. Inside this plate there are one or two thin displaced inner plates 44 to ensure that no IR radiation leaks out. In that part of the protecting means which lets in fresh air, the inner plates can, depending on the design of the guide vanes as stated above, be wholly or partly excluded.

Operation of the Embodiments

The hot exhaust gases (solid arrows) flow out through the nozzle of the ejector and entrain cool fresh air from the exterior (sparsely dashed arrows) through the protecting means into the ejector. There the two gases are mixed with each other. The mixture is additionally improved in the expansion nozzle of the ejector, which is also necessary for the efficiency of the ejector. The gas mixture (tightly dashed arrows), which is considerably cooler than the hot gases, is pressed through another part of the protecting means to the atmosphere. In vessels, the inlet part of the protecting means is conveniently arranged in front of its outlet part; in stationary units below this. Further cooling of both the mixture and that part of the protecting means which lets out these gases is provided by heat being conducted through the protecting means from that part which lets out mixed gases to that part which lets in fresh air. The inner plates are therefore preferably made of a material with good thermal conductivity, such as aluminium. The received radar radiation is reflected by the protecting means away from the sender in the same as the surrounding wall of e.g. the vehicle. The protecting means also provides for, possibly together with parts of the ejector, screening off IR radiation from hot parts in the exhaust device.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for reducing the signature of hot gases from an exhaust of a unit, said device comprising a mixing element for mixing the hot gases with fresh air from the exterior of the unit to form a gas mixture to be discharged to the exterior of the unit, and a protecting component which relative to the unit is arranged outside the mixing element or parts thereof, said protecting component reducing reflection of incoming surveillance radiation and including through ducts for passing at least parts of the gas mixture to the exterior.

2. The device as claimed in claim 1, wherein the protecting component includes parts which are made of an electrically conductive material, said protecting component having a plane surface facing the exterior, and the ducts being configured to prevent passage of the incoming surveillance radiation.

3. The device as claimed in claim 1, wherein each duct has an opening towards the exterior with a circumference that does not exceed the wavelength of the surveillance radiation.

4. The device as claimed in claim 1, wherein the protecting component has through openings for passing at least parts of the fresh air from the exterior to the mixing element.

5. The device as claimed in claim 1, wherein the protecting component is mounted in a wall of the unit with a plane surface of said protecting component being flush with an outer surface of the wall.

6. The device as claimed in claim 1, further comprising a space which accommodates at least parts of the mixing element, said space defined by a shell towards the unit and by the protecting component towards the exterior of the unit.

7. The device as claimed in claim 1, wherein said mixing element is an ejector operated by the hot gases.

8. The device as claimed in claim 1, wherein the protecting component has elements for screening off radiation to the exterior from hot parts of the mixing element.

9. The device as claimed in claim 8, wherein the elements of the protecting component comprise parts of the mixing element.

10. The device as claimed in claim 9, wherein the mixing element is an ejector and said parts thereof include guide vanes.

11. A device for reducing the signature of hot gases from an exhaust of an exhaust-emitting unit and also for reducing reflection of incoming surveillance radiation, said hot gases being mixed with cooler air downstream of said exhaust to form a mixed gas, said device comprising a protecting component mounted in a wall of said unit and having an outer surface facing an exterior of said unit with a plurality of ducts therein for passing at least part of said mixed gas to said exterior, said outer surface being flush with said wall and said ducts having a circumference smaller than the wavelength of said surveillance radiation.

12. The device as set forth in claim 11, wherein said protecting component contains an electrically conductive material in conductive contact with the wall.

13. The device as set forth in claim 11, wherein the outer surface of the protecting component is plane.

14. The device as set forth in claim 11, wherein the protecting component includes openings for passing at least part of the cooler air from the exterior that is mixed with the hot gases.

15. The device as set forth in claim 11, wherein said protecting component includes a screen plate with holes having a diameter substantially equal to said duct circumference, but offset with respect to said ducts.

* * * * *